US005739462A

United States Patent [19]

Poor et al.

[11] Patent Number: 5,739,462

[45] Date of Patent: Apr. 14, 1998

[54] METHOD AND APPARATUS FOR CREATING PYROTECHNIC EFFECTS

[75] Inventors: Kyle W. Poor, Clermont; John W. Sogge, Orlando, both of Fla.

[73] Assignee: The Walt Disney Company, Burbank, Calif.

[21] Appl. No.: 495,262

[22] Filed: Jun. 27, 1995

[51] Int. Cl.[6] ..... F42B 4/26; F42B 4/04

[52] U.S. Cl. ..... 102/342; 102/395; 102/351; 102/352; 102/357; 102/361; 102/440

[58] Field of Search ..... 102/361, 342, 102/345, 351, 352, 357, 205, 217, 431, 440; 89/1.815, 1.816

[56] References Cited

U.S. PATENT DOCUMENTS

| | | | |
|---|---|---|---|
| 41,173 | 1/1864 | Amici . | |
| 278,005 | 5/1883 | Fredricks et al. . | |
| 356,651 | 1/1887 | Linton . | |
| 399,882 | 3/1889 | Graydon . | |
| 421,310 | 2/1890 | Reynolds . | |
| 502,759 | 8/1893 | Rapieff . | |
| 1,478,597 | 12/1923 | Bebler . | |
| 1,550,670 | 8/1925 | Brandt | 102/24 |
| 1,762,044 | 6/1930 | Bedient | 102/24 |
| 1,922,081 | 8/1933 | Driggs | 102/21 |
| 2,006,271 | 6/1935 | Hitt | 102/20 |
| 2,053,772 | 8/1936 | Fabrizio | 102/25 |
| 2,086,618 | 7/1937 | Hitt | 102/23 |
| 2,087,281 | 7/1937 | Fabrizio | 102/23 |
| 2,130,068 | 9/1938 | Cimorosi | 102/20 |
| 2,311,721 | 2/1943 | Wilson | 11/23 |
| 2,783,138 | 2/1957 | Parsons | 52/0.5 |
| 2,809,624 | 10/1957 | Becher et al. | 124/11 |
| 3,025,633 | 3/1962 | Kaye et al. | 46/74 |
| 3,032,970 | 5/1962 | Fox | 60/35.3 |

(List continued on next page.)

FOREIGN PATENT DOCUMENTS

| | | |
|---|---|---|
| 2659429 | 9/1991 | France . |
| 2424900 | 12/1974 | Germany . |
| 3812644 | 3/1988 | Germany . |
| 5649900 | 5/1981 | Japan . |
| 2195198 | 8/1990 | Japan . |
| 1410798 | 10/1975 | United Kingdom . |
| 2195420 | 4/1988 | United Kingdom . |

OTHER PUBLICATIONS

Drawing re "Oriental Shell 'Warimono' Class* Single--Break" giving detailed description thereof, one page.

Drawing describing in depth "Canister Shell Repeating Color/Effect," one page.

Drawing describing in depth "Roman' Candle"; Gerbe' (Fountain)'; and Mine Bag, one page.

Cover page of Scientific American magazine, No. C.2, one page showing Fireworks, Article entitled.

"Pyrotechnics" by John A. Conkling, Scientific American magazine Jul. 1990, pp. 96–102.

"Design of Automatic Machinery," copyright 1985 (attached) one page.

*Primary Examiner*—Peter A. Nelson

*Attorney, Agent, or Firm*—Pretty, Schroeder & Poplawski

[57] ABSTRACT

A pyrotechnic device includes a launcher for launching and igniting a plurality of pyrotechnic stars for creating an aerial fireworks display. The launcher comprises a launching tube having an igniter that ignites the pyrotechnic stars as they are being expelled from the launching tube under the force of pressurized air. The igniter may comprise a section of the launching tube having a locally reduced diameter so that the pyrotechnic star frictionally engages it during launch, causing a striker composition on the interior of the launching tube to ignite a prime composition on the exterior surface of the pyrotechnic star. Alternatively, the igniter may comprise a flame within the launching tube to ignite the prime composition on the star. Various feeding mechanisms are provided to rapidly feed a large number of pyrotechnic stars for launching from the launching tube. The launcher utilizes pressurized air to launch the pyrotechnic stars and, thus, minimizes adverse environmental impact.

26 Claims, 8 Drawing Sheets

U.S. PATENT DOCUMENTS

| | | | |
|---|---|---|---|
| 3,068,756 | 12/1962 | Schermuly | 89/1.5 |
| 3,102,477 | 9/1963 | Stefan et al. | 102/37.6 |
| 3,263,563 | 8/1966 | Brown | 89/1.5 |
| 3,385,163 | 5/1968 | Kotikov | 89/1 |
| 3,397,476 | 8/1968 | Weber | 43/6 |
| 3,481,246 | 12/1969 | Snyder | 89/1.5 |
| 3,500,746 | 3/1970 | Ambrosini | 102/70.2 |
| 3,535,809 | 10/1970 | Hoffmann | 42/1 |
| 3,665,862 | 5/1972 | Lane | 102/103 |
| 3,670,649 | 6/1972 | Hartlein et al. | 102/38 |
| 3,698,317 | 10/1972 | Finch | 102/37.4 |
| 3,726,266 | 4/1973 | Palmer | 124/11 R |
| 3,739,726 | 6/1973 | Pintell | 102/70.2 R |
| 3,747,532 | 7/1973 | Berger | 102/97 |
| 3,752,082 | 8/1973 | Kernan | 102/361 |
| 3,802,407 | 4/1974 | Imazu | 124/11 R |
| 3,827,360 | 8/1974 | Geimer | 102/70 F |
| 3,901,153 | 8/1975 | Brabets et al. | 102/38 |
| 3,927,616 | 12/1975 | Axelrod et al. | 102/43 R |
| 3,964,395 | 6/1976 | Kaiser et al. | 102/70.2 R |
| 3,977,325 | 8/1976 | Jacobsen et al. | 102/43 R |
| 3,987,731 | 10/1976 | Brzuskiewicz | 102/43 R |
| 4,040,334 | 8/1977 | Smethers, Jr. | 89/1.804 |
| 4,069,761 | 1/1978 | Jimenez | 102/37.4 |
| 4,116,133 | 9/1978 | Beuchat | 102/215 |
| 4,128,039 | 12/1978 | Skliris | 89/1.803 |
| 4,233,673 | 11/1980 | Cricchi et al. | 365/184 |
| 4,383,468 | 5/1983 | Sie et al. | 86/1 R |
| 4,419,933 | 12/1983 | Kirby et al. | 102/206 |
| 4,421,030 | 12/1983 | Dekoker | 102/218 |
| 4,424,745 | 1/1984 | Magorian et al. | 102/215 |
| 4,445,435 | 5/1984 | Oswald | 102/215 |
| 4,586,437 | 5/1986 | Miki et al. | 102/220 |
| 4,644,864 | 2/1987 | Komorowski et al. | 102/493 |
| 4,664,035 | 5/1987 | Osofsky | 102/215 |
| 4,690,060 | 9/1987 | Dietrich | 102/352 |
| 4,697,518 | 10/1987 | Lau et al. | 102/358 |
| 4,705,655 | 11/1987 | Maures et al. | 264/3.4 |
| 4,711,047 | 12/1987 | Meller | 102/342 X |
| 4,712,477 | 12/1987 | Aikou et al. | 102/206 |
| 4,771,695 | 9/1988 | Simpson | 102/343 |
| 4,799,666 | 1/1989 | Obligio | 102/361 X |
| 4,825,765 | 5/1989 | Ochi et al. | 102/206 |
| 4,829,899 | 5/1989 | Wiker et al. | 102/206 |
| 4,917,015 | 4/1990 | Lowery | 102/342 |
| 4,930,393 | 6/1990 | Castro, Jr. | 89/1.814 |
| 5,157,225 | 10/1992 | Adams et al. | 102/493 |
| 5,187,323 | 2/1993 | Saxby | 102/440 |
| 5,259,318 | 11/1993 | Alker et al. | 102/334 |
| 5,282,455 | 2/1994 | Adamson et al. | 89/1.804 X |
| 5,295,438 | 3/1994 | Hill et al. | 102/217 |
| 5,323,707 | 6/1994 | Norton et al. | 102/931 |
| 5,339,741 | 8/1994 | Craven et al. | 102/361 |
| 5,425,310 | 6/1995 | Weber | 102/342 |
| 5,429,053 | 7/1995 | Walker | 102/342 |

FIG. 7
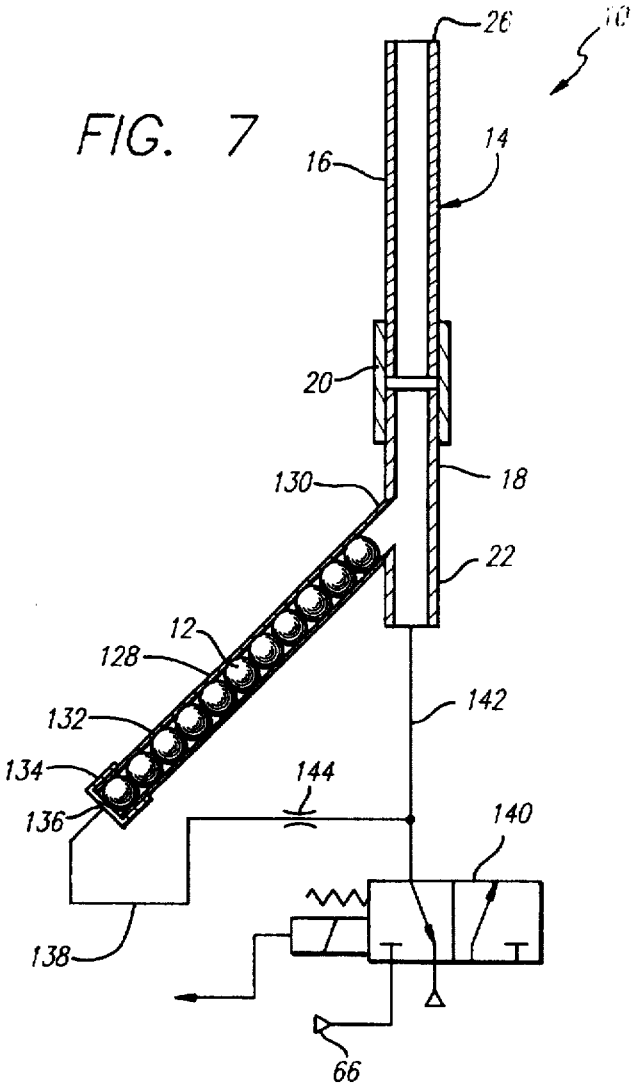
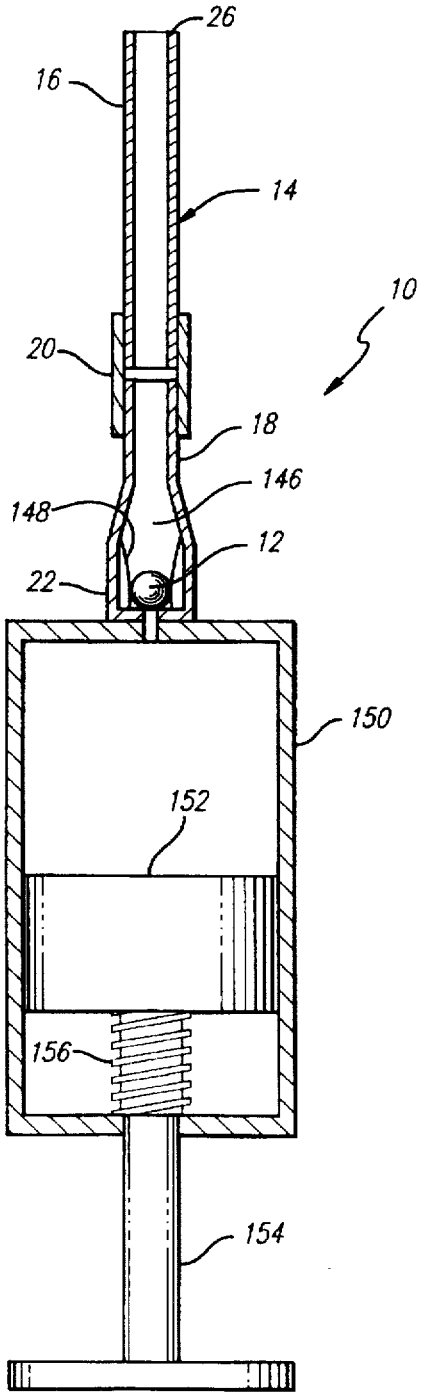
FIG. 8

METHOD AND APPARATUS FOR CREATING PYROTECHNIC EFFECTS

BACKGROUND OF THE INVENTION

The present invention relates to pyrotechnic effects and, more particularly, to a method and apparatus for creating fireworks effects similar to those created by roman candles, comets, mines and fountains.

As this invention, in its most basic form, has particular application with respect to roman candles, it will be primarily discussed in that context. However, it will be appreciated that this invention, as described below, has much broader applications to fireworks and pyrotechnic effects in general. Therefore, the embodiments and applications of the invention discussed herein have been provided for purposes of illustration and not by way of limitation.

Roman candles often are used in creating fireworks displays and other pyrotechnic effects at amusement parks, fairs and other entertainment venues. Roman candles are well known for the pyrotechnic effects that they create, in which balls or stars of fire are emitted from a tube at spaced intervals of about every three to six seconds. The altitude to which the stars are launched can vary widely, but the maximum altitude is usually about 150 feet.

A typical roman candle comprises a cardboard mortar tube containing anywhere from eight to twelve pyrotechnic stars. The stars are propelled out of one end of the tube by black powder lift charges that ignite underneath each star. Hence, the tube is alternately packed with black powder lift charges and pyrotechnic star compounds, with a felt or paper disk interposed between these layers to separate the black powder lift charges from the pyrotechnic stars. A chemical time delay fuse also is used to connect each layer.

By lighting the first chemical time delay fuse at the top of the tube, the first black powder lift charge is ignited. The resulting explosion creates the heat and energy necessary to ignite the first star and simultaneously propels it out of the tube. The explosion created by the first black powder lift charge also lights the second chemical time delay fuse for the second black powder lift charge. When this second fuse expires, the second black powder lift charge is ignited, creating another explosion that ignites the second pyrotechnic star and propels it out of the tube. This sequence continues until all of the pyrotechnic stars have been launched.

Traditional roman candle devices are inherently limited with respect to, among other things, the number of stars that can be launched from each device, the timing and precision of the pyrotechnic effect, and the altitude to which the pyrotechnic stars are launched.

For example, most commercially available roman candles contain only about eight to twelve pyrotechnic stars. When all of the stars have been launched, the cardboard mortar tube is essentially useless and usually is thrown away. Moreover, in fireworks displays involving a large number of roman candle stars, multiple roman candle devices must be set up in advance and integrated into the firing sequence to produce the desired effect. This increases the complexity and amount of coordination associated with production of the fireworks display. It also increases the quantity of waste that must be handled and discarded.

Yet another disadvantage of existing roman candle devices is the relatively slow rate at which the pyrotechnic stars are launched from the cardboard tube. The slow launch rate is directly related to the burn rate of the chemical delay fuse. Current roman candle devices are configured to launch a pyrotechnic star roughly every three to six seconds. This slow launch rate restricts the application of this pyrotechnic effect in fireworks displays requiring rapid launching of the stars. Furthermore, the amount of delay between the launching of one star to the next cannot be varied with precision, since the delay time is determined during the manufacturing process at the factory and, as noted above, it is limited by the burning characteristics of the chemical time delay fuse.

Likewise, the altitude to which the pyrotechnic star is launched is governed primarily by the size of the black powder lift charge underneath it. If it is desired to launch each star to the same altitude, difficult challenges are presented. For example, variations in black powder composition, black powder quality, the size of the pyrotechnic star and the configuration of the cardboard tube all contribute to the inherent lack of uniformity of altitude for each star. These variations can only be confined within tolerances that are obtainable during conventional hand-manufacturing techniques.

A related difficulty also arises in that each succeeding pyrotechnic star is being launched from a successively longer tube. The lengthening of the tube therefore changes the interior ballistics of each launch. To compensate for the longer tube, the quantity of the black powder lift charge under each succeeding star must be adjusted by precise measurements. Unfortunately, this would complicate the manufacturing process and add significantly to the cost of the roman candle. Thus, it has not been practical to attempt to consistently launch the stars to the same altitude with the existing roman candle devices.

In addition, existing roman candle devices are generally not capable of launching the pyrotechnic stars to altitudes in excess of 150 feet. As a result, these roman candle devices generally are not used in fireworks displays that are presented at relatively high altitudes. This can have a detrimental effect on fireworks displays that will be presented at the higher altitudes above 150 feet in which the pyrotechnic effect of the roman candle would be desirable.

Of course, another drawback associated with existing roman candle devices is their adverse impact on the environment. The current method of projection, using black powder lift charges to launch the pyrotechnic stars, creates extremely corrosive agents, such as sulfuric acid and other harmful chemicals, which have a detrimental environmental impact on the ground and any water in or around the firing site. Moreover, launching of the pyrotechnic stars using black powder lift charges creates large quantities of smoke on the ground at the time of firing. The smoke can be very distracting to guests observing the fireworks display and may divert their attention from the display itself. In some cases, large quantities of smoke may be blown toward the guests, causing further irritation.

To partially overcome these problems, one option that has been available involves replacing of the roman candles with comets. In general, a comet produces a pyrotechnic effect that is similar to a roman candle. However, the comet suffers a significant disadvantage because it is a single-shot device. Therefore, to duplicate the pyrotechnic display created by a roman candle device by using single-shot comets would require, among other things, a significant amount of electrical wiring and a corresponding increase in the complexity of the firing control system.

Accordingly, there has existed a definite need for a device that is capable of launching pyrotechnic stars at a rapid rate, that can ignite the stars in a precise and repeatable manner, and that can launch a large number of such stars from a single device at higher altitudes. The present invention satisfies these and other needs, and provides further related advantages.

SUMMARY OF THE INVENTION

The present invention provides a launcher for simultaneously launching and igniting a pyrotechnic compound or projectile, such as a fireworks projectile. The resulting effect, which can include various colors, glitters and sounds, may constitute a portion of a larger fireworks display. The launcher is capable of launching a plurality of the fireworks projectiles at a rapid rate of fire, up to six shots per second or more. It also can launch a large number of fireworks projectiles without having to reload the launcher, and it can launch and ignite the fireworks projectiles in a consistent and repeatable manner. Furthermore, the launcher is capable of launching the fireworks projectiles at relatively high altitudes, approaching 300 feet or more, as well as lower altitudes, in an accurate, consistent and repeatable manner.

In one form of the invention, the launcher comprises a roman candle fireworks device for launching pyrotechnic stars. The launcher comprises a loading chamber for receiving the pyrotechnic stars to be launched, and a launching tube having a lower end registerable with the loading chamber and an open upper end for expelling the fireworks projectile into the air. An igniter is provided between the ends of the launching tube for igniting the pyrotechnic star after it has been launched but before it has been expelled from the launching tube. The pyrotechnic stars are launched by pressurized gas introduced into the loading chamber to expel the pyrotechnic star from the open end of the launching tube.

In one aspect of the invention, the igniter comprises an interior section of the launching tube having a locally reduced cross-sectional area and a striker composition coated on the interior of the tube in this area. The exterior surface of the pyrotechnic star is coated with a combustible composition that can be ignited by frictional contact between the pyrotechnic star and the striker composition as the star is being expelled from the launching tube. By way of example, the striker composition on the interior of the launching tube may comprise red phosphorous and the combustible composition coated on the exterior surface of the pyrotechnic star may comprise potassium chlorate or potassium perchlorate or a relative mixture of these two active ingredients.

Alternatively, the igniter may comprise a side opening in the launching tube and a flame that is introduced through the opening into the interior of the tube. As the pyrotechnic star is propelled out of the launching tube, the combustible composition on the exterior surface of the star is ignited by the flame as the pyrotechnic star passes through the flame. The igniter also may comprise electrically heated wires arranged longitudinally on the interior of the launching tube which contact the pyrotechnic star and ignite the combustible composition as the star is being expelled from the launching tube.

In another aspect of the invention, a feeding mechanism is provided for feeding a plurality of the pyrotechnic stars into a launching position under the launching tube. The feeding mechanism can take various forms, one of which comprises at least one storage tube adjacent to the launching tube. The lower end of the launching tube and the lower end of the storage tube are each connected to a manifold, with a slide under the manifold having a load chamber or cylinder for receiving and transferring a pyrotechnic star from the storage tube to the launching tube. An appropriate mechanism for reciprocating the slide is provided. In the first position of the slide, the load cylinder is registered below the storage tube and receives a pyrotechnic star and, in the second position, the load cylinder is registered below the launching tube. Thus, the slide can be moved back and forth to continually transfer pyrotechnic stars from the storage tube into the appropriate launch position aligned with the launching tube.

In other aspects of the feeding mechanism, a plurality of storage tubes for holding a plurality of the pyrotechnic stars may be provided. The storage tubes may be arranged in a linear manner on opposite sides of the launching tube, or they may be arranged in a circular pattern. When the storage tubes are arranged in a linear fashion, the slide is adapted to move in a longitudinal direction aligned with the storage tubes. When the storage tubes are arranged in a cylindrical pattern, a cylindrical plate under the manifold having a plurality of load cylinders in its perimeter is rotated to transfer the pyrotechnic stars from the storage tubes to the launching tube.

In further embodiments of the launcher, the feed mechanism may comprise a storage tube for holding the pyrotechnic stars, with a top end of the tube connected to the launching tube and a lower end offset from the launching tube. The introduction of pressurized gas to launch a pyrotechnic star from the launching tube also causes pyrotechnic stars within the storage tube to be fed into the launching tube, thus creating a fountain of stars effect. In still other embodiments, the launcher may comprise a single-shot launcher, with a piston movable within a cylinder under the launching tube. Movement of the piston by the action of a spring toward the launching tube pressurizes air in the cylinder pyrotechnic star from the launching tube.

If desired, a mechanism for tilting the launcher and thereby adjusting the launching angle of the pyrotechnic star may be provided. The tilting mechanism comprises at least one motive element that rotates the launcher in a vertical plane to a selected position. In this way, the launching angle of the pyrotechnic star can be adjusted and controlled to vary the resulting fireworks display.

Other features and advantages of the present invention will become apparent from the following description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 7 is a cross-sectional view of still another embodiment of the launcher;

FIG. 8 is cross-sectional view of yet another embodiment of the launcher; and

DETAILED DESCRIPTION OF THE PREFERRED EMBODIMENT

Figure 1:
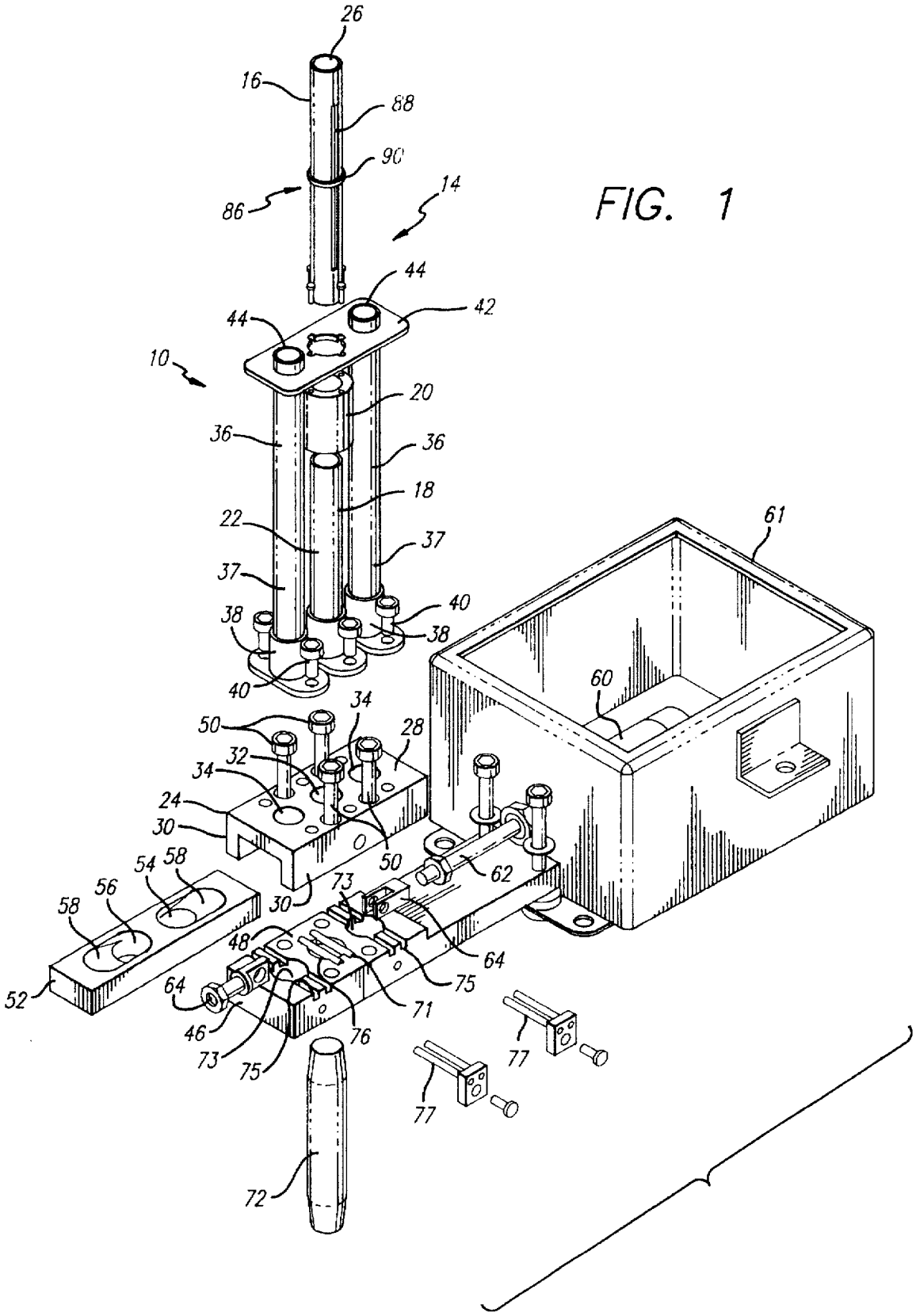
FIG. 1 is a perspective assembly view of one embodiment of a launcher embodying the novel aspects of the present invention.

As shown in the exemplary drawings, the present invention is embodied in a launcher, referred to generally by the reference numeral 10, for launching pyrotechnic stars 12, as well as other similar fireworks projectiles. The launcher 10 is capable of launching these stars 12 at a rapid rate, igniting the stars in a precise and repeatable manner, and launching a large number of such stars from a single launcher to high altitudes. Moreover, the launcher 10 provides all of these advantages while minimizing the environmental impact associated with the launching and igniting of the stars.

Figure 2:
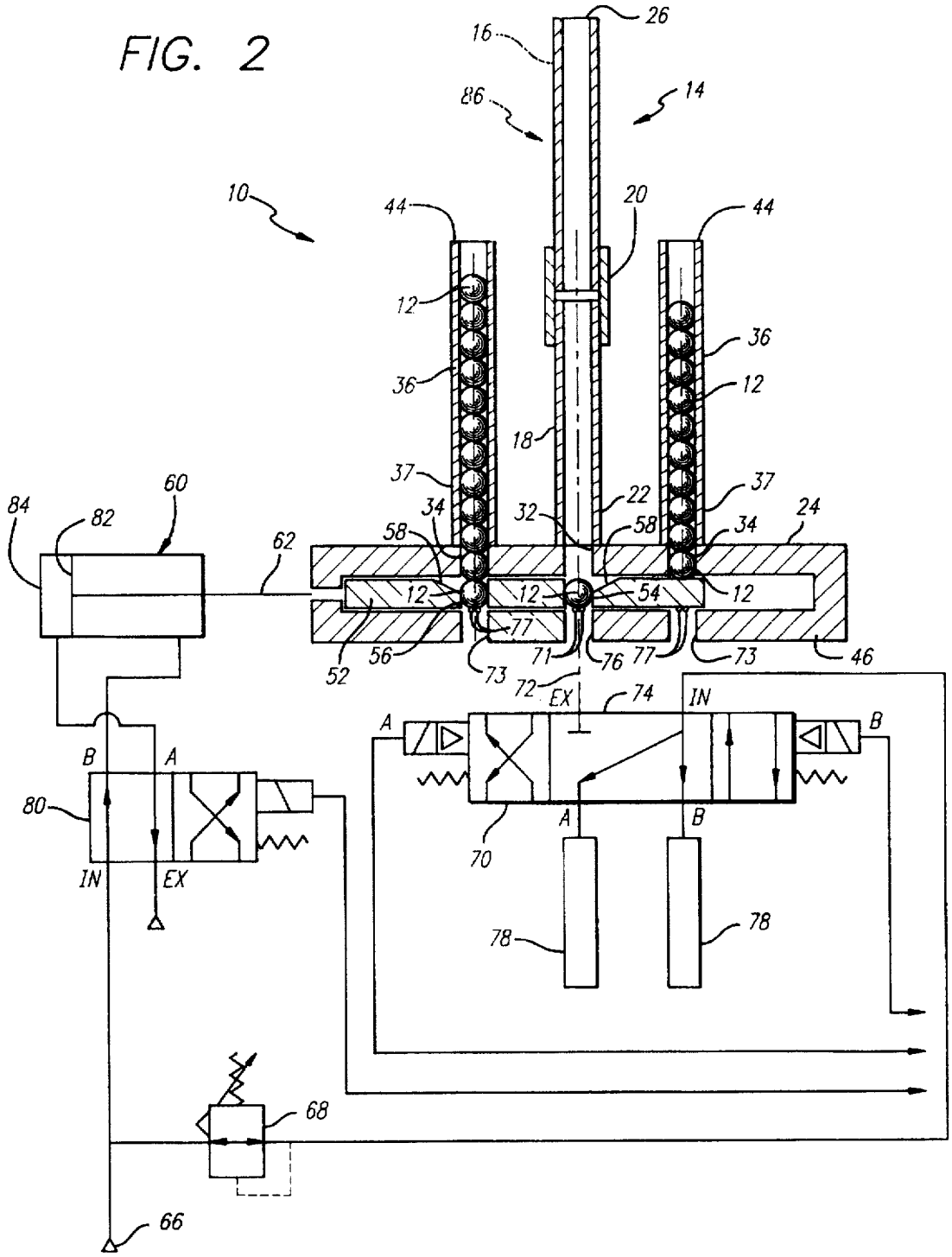
FIG. 2 is a diagrammatic cross-sectional view of the launcher, with some of its related systems shown schematically.
Figure 3:
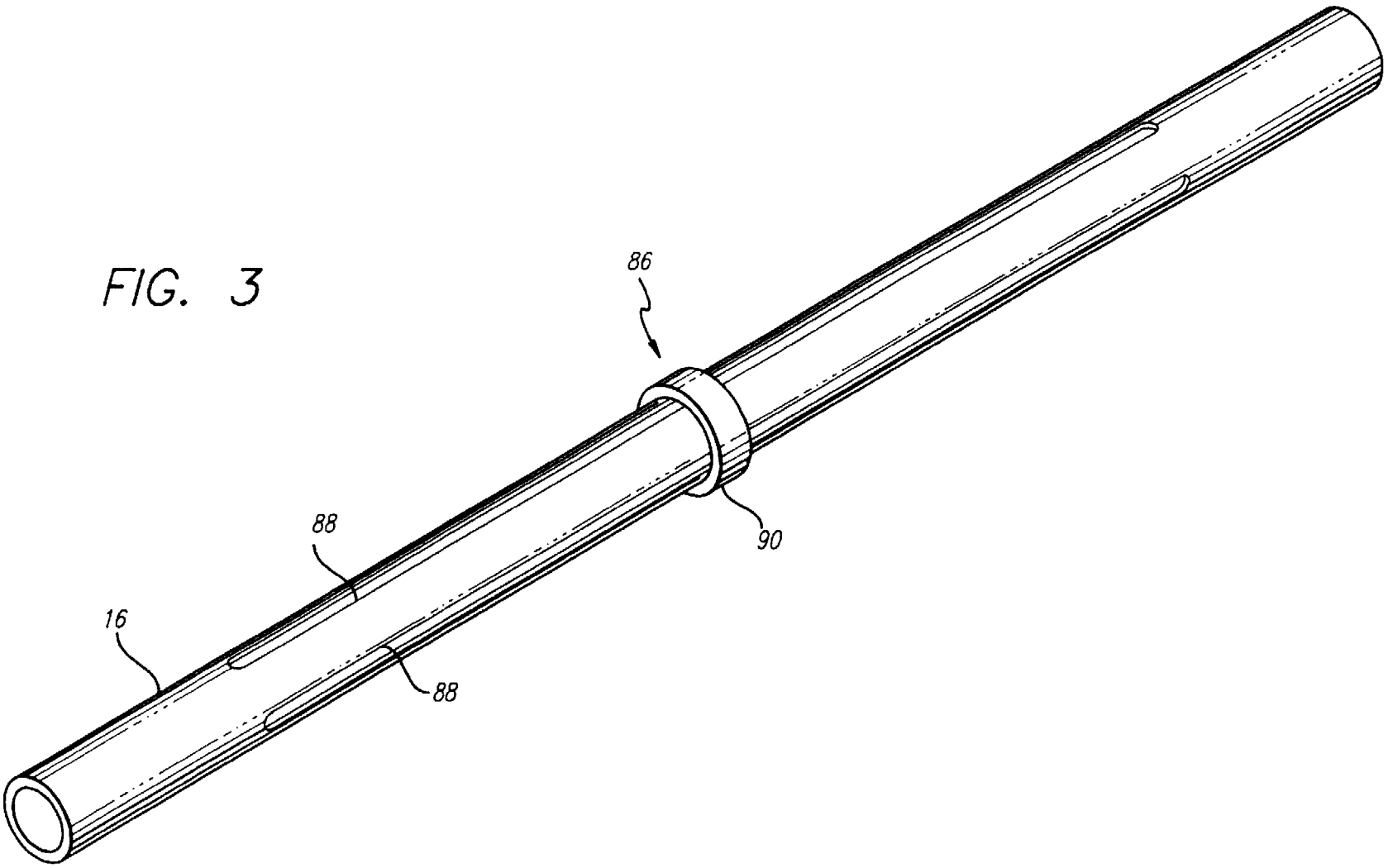
FIG. 3 is a perspective view of a launching tube of the launcher.

FIGS. 1–3 show one embodiment of the launcher 10 in which the pyrotechnic stars 12 are launched from a central launching tube 14. The launching tube 14 has an upper section comprising a striker tube 16 and a lower section comprising a basic launch tube 18. These two launching tube sections 16 and 18 are connected together by a coupling 20. The launching tube 14 has its lower end 22 connected to a manifold 24, and it has an open upper end 26 for expelling the pyrotechnic star 12 into the air.

The manifold 24 substantially resembles an inverted "U" in cross-section, and comprises an upper surface 28 and two side surfaces 30 extending downwardly from the upper surface. Three apertures are provided in the upper surface 28 of the manifold 24, comprising a launch chamber or aperture 32 and two feed apertures 34 on opposite sides of the launch aperture. The lower end 22 of the launching tube 14 is registered with the launch aperture 32 such that pyrotechnic stars 12 can be launched through the launch aperture and into the launching tube.

A pair of storage tubes 36 are each registered with a respective one of the feed apertures 34 on the manifold 24. Thus, each storage tube 36 has its lower end 37 connected to the manifold 24 and registered over one of the feed apertures 34. In this regard, both the launching tube 14 and each storage tube 36 may be connected to the manifold by a bracket 38 and bolts 40, or by other suitable means.

The upper end of each storage tube 36 is linked to the launching tube 14 by a brace 42 to provide increased stability of the launcher 10. The storage tubes 36 also have an open upper end 44 and are designed to receive and hold a number of the pyrotechnic stars 12. As explained below, the pyrotechnic stars 12 in the storage tubes 36 are fed to a location under the launch aperture 32 of the manifold 24 for subsequent firing out of the launching tube 14.

The side surfaces 30 of the manifold 24 are connected to a base 46 having a substantially planar upper surface 48. The manifold 24 may be connected to the base 46 by bolts 50 or other appropriate fasteners. Within the rectangular space defined by the upper surface 28 and side surfaces 30 of the manifold 24, and by the upper surface 48 of the base 46, is an elongated slide 52. The slide 52 has two load cylinders, comprising a right load cylinder 54 and a left load cylinder 56. The slide 52 is adapted to move back and forth with respect to the manifold 24 and transfer pyrotechnic stars 12 from the storage tubes 36 to a launching position under the launching tube 12.

The entrance leading to each load cylinder 54 and 56 preferably includes an inclined or ramped surface 58. The function of the ramped surfaces 58 is to avoid shearing the pyrotechnic star 12 in the bottom of the storage tube 36 above the star already loaded into the load cylinders 54 or 56. It is well known that there is a substantial manufacturing tolerance associated with the sizes of the spherical or cylindrical shaped stars. For example, if the star 12 in the load cylinder 54 or 56 is smaller than the designed nominal dimension, the next star in the storage tube 36 will protrude down into the slide 52. As the slide 52 is rapidly moved over to the launching position, this star could be sheared, creating a fire hazard as well as potentially damaging the star. Thus, the ramped surface 58 is used to lift the stack of stars 12 in the storage tube 36 without shearing the bottom one in the stack.

In one position of the slide 52, shown best in FIG. 2, the left load cylinder 56 is registered below one of the feed apertures 34 in the manifold 24 and its respective storage tube 36 containing a supply of the pyrotechnic stars 12. The right load cylinder 54 is registered below the launch aperture 32 of the manifold 24 and the launching tube 14 above it. Thus, in this position, a pyrotechnic star 12 is in the right load cylinder 54 and ready for launching out of the launching tube 14.

After the pyrotechnic star 12 in the right load cylinder 54 has been launched, the slide 52 moves to the right in the drawing, and the pyrotechnic star in the left load cylinder 56 is transferred into a position for launching under the launching tube 14. At this point, the right load cylinder 54 will now be registered underneath the right feed aperture 34 and the storage tube 36 above it containing a supply of the pyrotechnic stars 12. Once the right load cylinder 54 is registered with the storage tube 36 in this manner, one of the pyrotechnic stars 12 from the storage tube will move by the force of gravity into the right load cylinder. This pyrotechnic star 12, therefore, is now ready for transfer to a position under the launching tube 14 for launching when the slide 52 is moved back to the first position shown in FIG. 2. This process of moving the slide 52 back and forth is repeated as desired to launch the pyrotechnic stars 12 in numbers and at a rate as may be required under the circumstances of the particular fireworks display that is desired.

In one aspect of the invention, the slide 52 is reciprocated back and forth with respect to the manifold 24 by a reciprocating device 60 within a housing 61. The reciprocating device 60 includes an arm 62 connected to one end of the slide 52 by various couplings 64. The device 60 is adapted to move the arm 62 in and out of the housing, and, thus, move the slide 52 and its load cylinders 54 and 56 with respect to the manifold 24 and the storage tubes 36 and launching tube 14. As explained below, the reciprocating device 60 and the stroke of its arm 62 are configured such that, with each stroke of the arm, one of the load cylinders 54 or 56 is registered under the launching tube 14 and the other load cylinder 54 or 56 is registered under one of the storage tubes 36.

A significant feature of the launcher 10 is the rapid rate at which it can launch the pyrotechnic stars 12. One aspect of the launch rate is governed by the speed of the reciprocating device 60 and the corresponding rate of movement of the slide 52. Of course, the launch rate of the pyrotechnic stars 12 can be varied as desired, but launch rates presently are contemplated as high as six pyrotechnic stars per second. Thus, a reciprocating device 60 capable of reciprocating the slide 52 up to six times per second would be necessary under these circumstances.

The pyrotechnic stars 12 preferably are launched using a non-explosive launching medium. In the preferred embodiment, the launching medium is pressurized air provided from a 120 psi compressed air source 66 (see FIG. 2). The air source 66 feeds pressurized air through a pressure regulator 68 to a launch valve 70 located under the base 46 of the launcher 10. An air tube 72 connects an exhaust port 74 in the launch valve 70 to an opening 76 in the base 46 of the launcher 10.

Two pins 71 are positioned in a pair of slots across the opening 76 in the base 46. These pins 71 prevent the star 12 in the launching position (under the launch aperture 32) from descending into the opening 76 in the base 46, while still allowing the pressurized air to propel the star upward. Also within the base 46 are two cylindrical holes 73 registered axially with the feed apertures 34 in the manifold 24. The holes 73 in the base 46 have a pair of grooves 75 cut across the base's upper surface 48. These grooves 75 are designed to accept a corresponding pair of removable pins 77. The pins 77 prevent the stars 12 in the loading positions (under the storage tubes 36) from descending into the holes 73 in the base 46. The holes 73 have been provided in the base 46 to allow any loose powder or debris from the stars 12 in the storage tubes 36 to exit the launcher 10 without jamming the feeding mechanism (i.e., the slide 52). The pins 77 have been designed to be removed in order to unload unused stars 12 downward through holes 73, as may be necessary.

The launch valve 70 is a three-position, four-way air valve having two pilot-assisted solenoids and springs to provide the three necessary valve spool positions. The two output ports of the launch valve 70, labeled A and B in FIG. 2, are connected to first and second air storage pipes 78. As the launch valve 70 is shifted through its three positions, these storage pipes 78 are alternately filled and then exhausted through the exhaust port 74 of the launch valve leading to the air tube 72. The blast of air resulting from venting of the storage pipes 78 through the exhaust port 74 produces the launch force necessary to propel the pyrotechnic star 12 (in the load cylinder 54 or 56 of the slide 52 under the launch aperture 32 of the manifold 24) up the launching tube 14 and into the air.

The pressure regulator 68 controls the amount of pressurized air that fills the storage tubes 78. Thus, by appropriate adjustment of the pressure regulator 68, the storage pipes 78 can be filled to their full line pressure, they can be filled to a predetermined minimum launch pressure, or they can be filled to any pressure level in between these two extremes. In this way, launch altitudes can reach as high as 300 feet, or as low as 30 feet, or anywhere in between. Furthermore, altitudes between these ranges can be achieved consistently and accurately because the same amount of pressurized air is supplied to the stars 12 for each launch. Also, by providing the appropriate signals to the launch valve 70 from an external electronic control system (not shown), the storage pipes 78 can be vented as many as six times per second, in synchronization with movement of the slide 52, to launch as many as six pyrotechnic stars 12 per second.

The air source 66 also feeds a load valve 80 that controls the supply of pressurized air to operate the reciprocating device 60. The load valve 80 is a two-position, four-way air valve. The reciprocating device 60 comprises a piston 82 that reciprocates within a cylinder 84. The arm 62 is connected to the piston 82 and moves in response to movement of the piston 82 within the cylinder 84. Thus, when the load valve 80 introduces air through the line A into the cylinder 84, the piston 82 is moved to the right in FIG. 2 and moves the slide 52 a corresponding amount, as previously discussed. When the load valve 80 exhausts line A and introduces pressurized air into the cylinder 84 through the line B, however, the piston 82 is moved in the opposite direction and the slide 52 is moved a corresponding amount to load another pyrotechnic star 12 into the launch position. Both the load valve 80 and the launch valve 70 can be controlled by the electronic control system to synchronize the opening and closing of these valves and the launching of pyrotechnic stars 12 at an appropriate rate and to a desired altitude.

Since the pyrotechnic stars 12 are launched using pressurized air, a method must be provided for igniting the stars before they are expelled out of the open end 26 of the launching tube 14. Accordingly, an ignition apparatus or igniter 86 is provided between the lower end 22 and the open upper end 26 of the launching tube 14 for igniting the pyrotechnic star 12 as it is being expelled from the launching tube.

FIG. 3 shows one embodiment of an ignition apparatus or igniter 86 for igniting the pyrotechnic star 12. This igniter 86 comprises the striker tube 16 that is coupled above the basic launch tube 18, as previously discussed and shown in FIGS. 1 and 2. The striker tube 16 has one or more longitudinal slots 88 that allow the striker tube to be radially constricted such that the interior diameter of the tube can be locally reduced. One way to locally reduce the interior diameter of the striker tube 16 is to provide a rubber band 90 or other elastomeric device around the striker tube in the area of the longitudinal slots 88. Alternatively, a spring urging against the outside surface of the striker tube 16 or other suitable means may be used.

In accordance with the invention, the locally reduced interior of the striker tube 16 is coated with a chemical striker composition, and the pyrotechnic stars 12 also are coated on their exterior surface with a corresponding combustible or prime composition. The prime composition is designed to ignite the star 12 upon frictional contact with the striker composition on the interior of the striker tube 16. The striker composition can comprise red phosphorous, and the prime composition can comprise either potassium chlorate or potassium perchlorate, or a relative mixture of these two active ingredients. Both potassium chlorate and potassium perchlorate are strong chemical oxidizing agents widely used in the fireworks industry, while red phosphorous represents a chemical reducing agent. The resulting contact between these compounds during the launch process initiates an exothermic chemical reaction capable of igniting the pyrotechnic stars 12. This ignition process is similar to that used to ignite the heads of safety matches on matchbooks.

It is anticipated that the striker tube 16 will be a replaceable item, due in part to the fact that the striker composition on its interior eventually will wear down and need to be replaced. Accordingly, the striker tube 16 can be manufactured from low-cost recyclable material, such as wound paper products and the like. Through use or empirical study, it will be determined approximately how long it will take before the striker composition on the interior of the striker tube 16 wears down and is unable to ignite a star 12. Thus, when a certain number of stars 12 have been launched, the striker tube 16 can be replaced before its striker composition is totally worn down and unable to light the stars. The replaceable aspect of the striker tube 16 also is desirable in the event of a defective striker tube that needs to be replaced on a short time frame, such as right before a fireworks show.

The design of the striker tube 16 allows the inside diameter to be locally reduced and thereby ensure that the pyrotechnic star 12 makes intimate contact with the striker composition as the star is being expelled from the launching tube 14. It has been found to be necessary to locally reduce the diameter of the striker tube 16, since the normal manufacturing tolerances in the sizes of the pyrotechnic stars 12 are quite large, i.e., more than ±0.030 inch, as compared to bullets or other projectiles, which are typically manufactured to tighter tolerances.

The two most common shapes for pyrotechnic stars 12 currently used by the fireworks industry are spherical and cylindrical. The spherical stars are generally manufactured by a rolling process that produces stars 12 with a greater dimensional tolerance than cylindrical stars. The cylindrical shaped stars are commonly referred to as "pump stars" as a result of the manufacturing method used to produce them. These pump stars are produced by pressing the semi-dry fireworks composition into a cylindrical die set. The stars are then ejected from the die set and dried. The resulting cylindrically shaped stars are therefore more consistent in shape, size, and weight than their spherical counterparts. The present invention has been designed to accommodate both shapes of stars. Subsequently, the stars 12 are coated on their exterior with the appropriate prime composition that will ignite when it frictionally contacts the striker composition on the interior of the striker tube 16.

Although a specific striker compound (red phosphorous) and specific prime compositions (potassium chlorate and potassium perchlorate), have been identified, it will be appreciated that other sympathetic chemical compounds and combinations thereof can be provided to achieve the necessary result of igniting the pyrotechnic star 12 by frictional contact with the striker tube 16 before the star is expelled by the pressurized air from the launching tube 14. Accordingly, it will be understood that the invention is not limited to the specific compositions and compounds identified herein, which have been provided for purposes of illustration.

Figure 4:
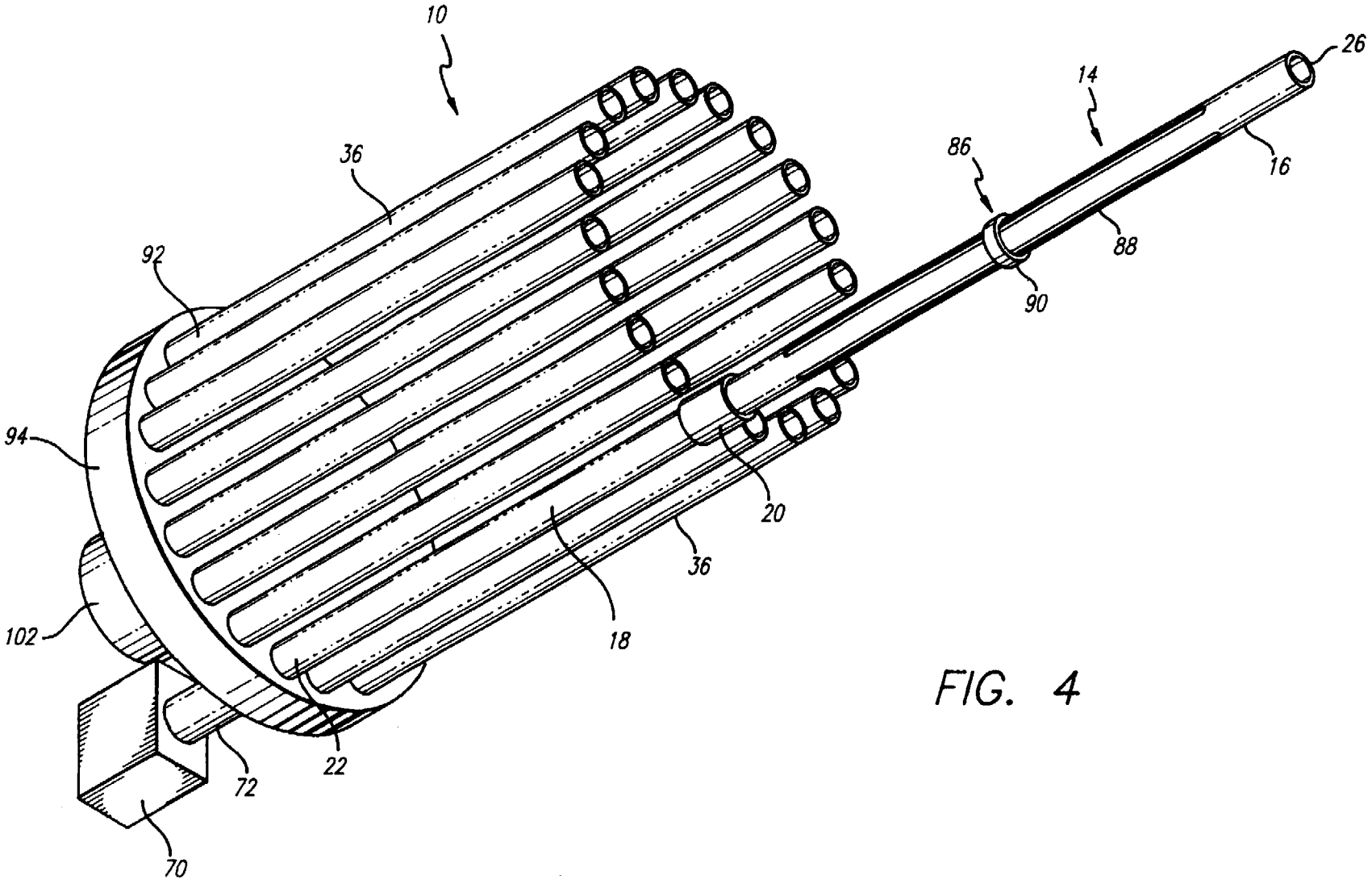
FIG. 4 is a perspective view of another embodiment of the launcher.
Figure 5:
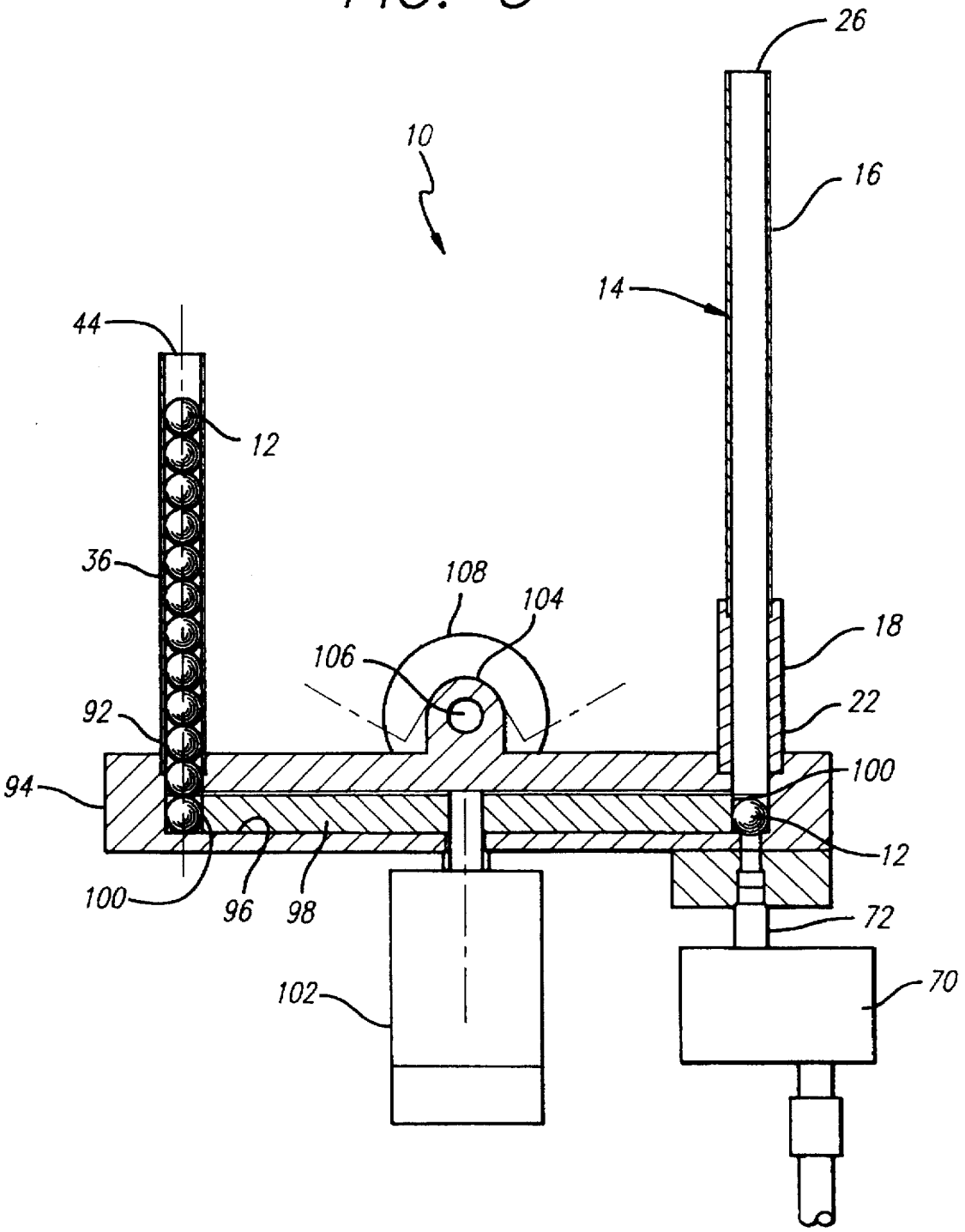
FIG. 5 is a diagrammatic cross-sectional view of the launcher of FIG. 4.

FIGS. 4–5 show another embodiment of the launcher 10. In this embodiment, the launcher 10 is capable of launching in excess of about 450 pyrotechnic stars 12 that can be stored in as many as nineteen storage tubes 36. This arrangement of feeding a large number of stars 12 to the launching tube 14 advantageously lengthens the time between reloading of the storage tubes 36. While nineteen storage tubes 36 are shown in FIGS. 4–5, it will be appreciated that a smaller or larger number of such tubes may be provided, depending upon the circumstances and the number of stars 12 that can be held in each storage tube 36.

The storage tubes 36 are arranged in a circular pattern and have their lower ends 92 connected to a cylindrical manifold 94 having an internal cylindrical loading chamber 96 containing a plate 98. The plate 98 has a plurality of load chambers or cylinders 100 corresponding to the number of storage tubes 36, plus the launching tube 14. Thus, the launcher 10 shown in FIGS. 4–5 has a plate with twenty load cylinders.

The plate 98 is rotated inside the cylindrical loading chamber 96 by a motor 102, such as a stepper motor. As the plate 98 is rotated, the pyrotechnic stars 12 move by the force of gravity into any empty load cylinders 100 in the plate. With each indexed rotation of the plate 98, one of the load cylinders 100 containing a pyrotechnic star 12 will be registered under the launching tube 14. After the launch valve 70 has opened and pressurized air has expelled the pyrotechnic star 12 from the launching tube 14, the stepper motor 102 rotates another load cylinder 100 with a pyrotechnic star 12 into registration with the launching tube 14.

The load cylinders 100 are located around the perimeter of the plate 98. When nineteen storage tubes and one launching tube 14 are used, the load cylinders 100 are provided in the plate every eighteen degrees. Similarly, the plate 98 is indexed eighteen degrees for each launch. An appropriate stepper motor 102 to effect this indexing comprises, for example, a DC stepper motor with a 10:1 gear reducer operable at 1.8 degree per step with 200 steps per index.

One significant advantage of this second embodiment of the launcher 10 is the large number of pyrotechnic stars 12 that it can hold and launch. Accordingly, the amount of time between reloading of the launcher 10 with further pyrotechnic stars 12 is substantially increased. This arrangement has an advantage over the launcher 10 shown in FIGS. 1–2, in that it can hold more stars 12. However, the launcher 10 of FIGS. 1–2 has an advantage over the launcher 10 of FIGS. 4–5 in that its mechanical complexity is somewhat lower.

An important feature of the storage tubes 36 in all of the embodiments discussed herein resides in the circumstance that the upper ends 44 of each storage tube and the holes 73 in the base 46 are open to the atmosphere (with the exception of minimal blockage by the pins 77 and 71). This feature allows the gas pressure and debris from an accidental ignition of the stars 12 in the storage tubes 36 to quickly and easily vent in both directions. If the storage tubes 36 were capped or plugged in some way, the opportunity for injury or damage to the launcher 10, should the pyrotechnic stars 12 accidentally ignite, would substantially increase. However, by leaving the storage tubes 36 open in both directions, any accidental ignition of the pyrotechnic stars 12 is likely to result in diverting the forces and debris resulting from the ignition out of the open upper ends 44 and the lower ends 92 of the storage tubes 36. This will advantageously minimize the damage to the launcher 10 and, more importantly, decrease the opportunity for injury to any personnel in the surrounding area.

Another feature of the second embodiment of the launcher 10 shown in FIG. 5 is the ability to tilt the launcher at an angle to launch the pyrotechnic stars 12 at a variety of different tragectories. To adjust the launching angle of the launching tube 14, the manifold 94 is provided with a hub 104 at its center and is fixed to a shaft 106 of a motor 108. The motor 108 is adapted to rotate the shaft 106 and thus change the angle of the launcher 10 with respect to the ground. A DC stepper motor, or other appropriate motive element, may be provided to adjust the angle of the launcher 10 with respect to the ground. Launching angles of 30 degrees with respect to the vertical are presently contemplated.

Figure 6:
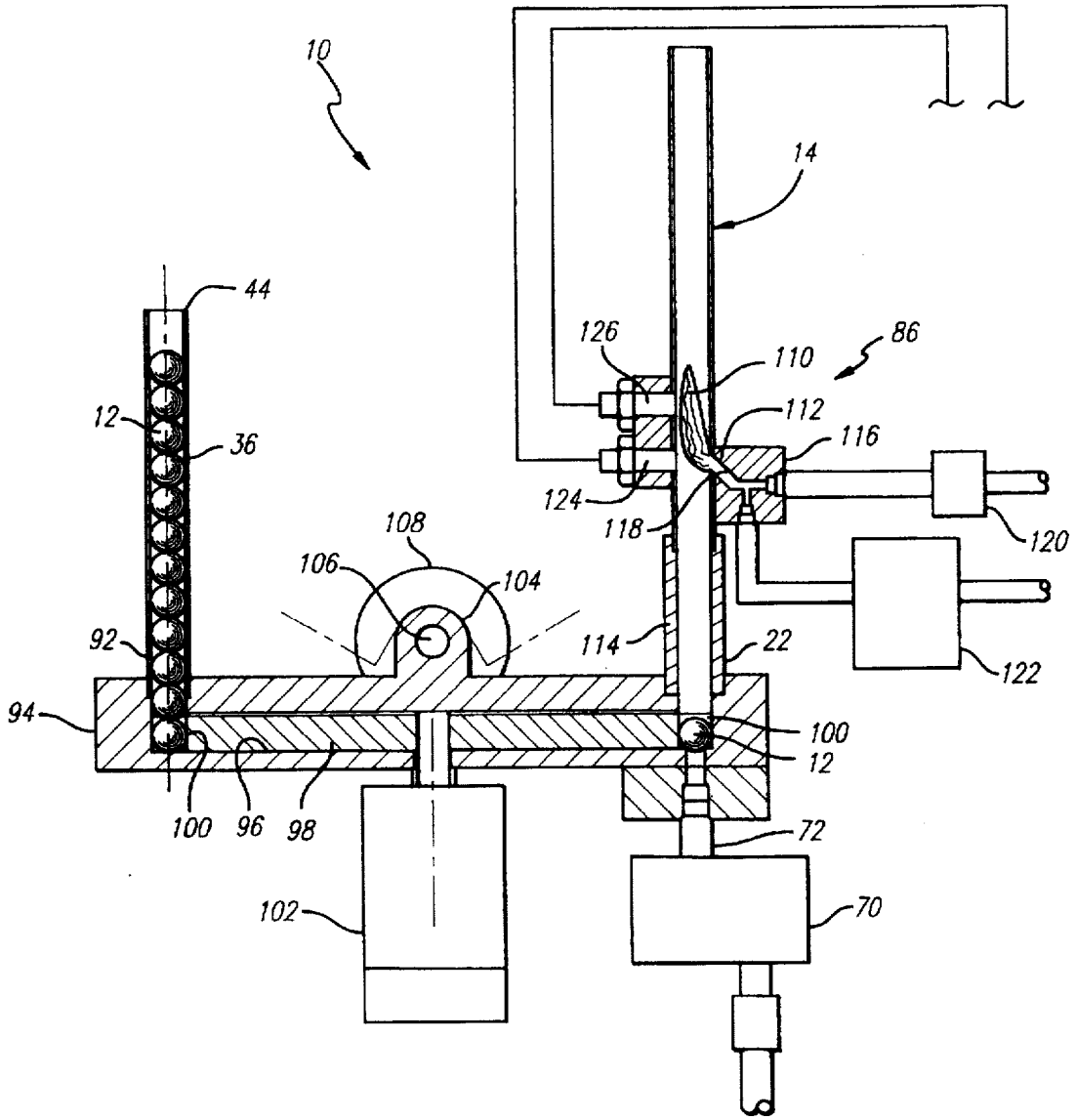
FIG. 6 is a cross-sectional view of a further embodiment of the launcher.

FIG. 6 shows a third embodiment of the launcher 10. This embodiment of the launcher 10 is similar to those discussed above, with the primary change residing in the igniter 86 that is employed to ignite the pyrotechnic stars 12 as they are being expelled from the launching tube 14. While the previous embodiments have shown a striker tube 16 having a locally reduced internal diameter coated with a striker composition, such as red phosphorous, the third embodiment of the launcher 10 shown in FIG. 6 utilizes a flame 110 to ignite the pyrotechnic star 12.

The flame 110 is introduced into the interior of the launching tube 14 through a side opening 112 provided in the side of the launching tube approximately mid-way between the upper and lower ends 22 and 26 of the launching tube 14. The lower portion of the launching tube 14 may comprise a thermally insulated barrel section 114 to prevent heat from the flame 110 from being transferred to the manifold 94 or other portions of the launcher 10. The flame 110 is created by introducing into the interior of the launching tube 14 an appropriate mixture of a combustible gas and air. A mixing block 116 having a flame nozzle 118 at the side opening 112 of the launching tube 14 is fed with combustible gas (such as propane) and air. A gas valve 120 regulates the flow of propane gas to the mixing block 116, and an air valve 122 regulates the flow of pressurized air from the air source 66 to the mixing block 116. Both the gas valve 120 and the air valve 122 may be two-way, two-position valves, with their flow controlled by a 24 VDC actuator.

On the other side of the launching tube 14 from the mixing block 116, are a spark igniter 124 and a temperature switch 126. The spark igniter 124 produces an electric spark to ignite the propane/air mixture and create the flame 110 within the interior of the launching tube 14. The temperature switch 126 measures the temperature of the flame 110 and, through appropriate control mechanisms linked to the gas valve 120 and the air valve 122, assists in regulating the amount of propane and air fed to the mixing block 116 to produce a flame 110 of appropriate size and temperature. It is understood, of course, that the launching tube 14 in this embodiment is made of a flame resistant material, at least in the area of the igniter 86.

Like the pyrotechnic stars 12 discussed above, the exterior surface of the stars in this embodiment also are coated with a prime composition, such as potassium chlorate and/or potassium perchlorate. When the launch valve 70 is opened and pressurized air flows through the air tube 72 to eject the pyrotechnic star 12 within the load cylinder 100, the star is rapidly moved through the launching tube 14 and passes through the flame 110. Upon contact with the flame 110, the prime composition on the star 12 is ignited before the star is expelled from the open end 26 of the launching tube 14.

Other types of igniters 86 could also be used. For example, the igniter 86 could comprise an electrically heated element inside the launching tube 14 that contacts and ignites the pyrotechnic star 12 as it is expelled from the launching tube. This electrically heated element could comprise a plurality of electrically heated wires arranged longitudinally on the interior of the launching tube 14.

FIG. 7 shows a fourth embodiment of the launcher 10 with a different mechanism for feeding pyrotechnic stars 12 for launching out of the launching tube 14. In this embodiment, a storage tube 128 is provided for holding a plurality of the pyrotechnic stars 12 to be launched. The storage tube 128 has a top end 130 connected to a point adjacent to the lower end 22 of the launching tube 14 and a lower end 132 that is offset at an angle from the launching tube. The lower end 132 of the storage tube 128 also is closed by an end cap 134 having a central aperture 136 for receiving pressurized air from an access line 138. The top end 130 of the storage tube 128 is open for feeding stars 12 into the launching tube 14.

Pressurized air is supplied to launch pyrotechnic stars 12 through a launch valve 140. The launch valve 140 may comprise, for example, a two-position, three-way, normally closed valve. Air is supplied from the launch valve 140 to the launch tube 14 via an air tube represented by the line 142. The access line 138 between the launch valve 140 and the launching tube 14 diverts some pressurized air and transfers it through the central aperture 136 in the end cap 134 at the lower end 132 of the storage tube 128. This access line 138 has a flow restriction 144 to reduce the amount of pressurized air supplied to the storage tube 128.

The foregoing configuration of the launcher 10 is designed to produce a rapid firing rate of the pyrotechnic stars 12, such that the stars are successively launched one after the other to produce a fountain effect, but without the use of a loading mechanism. Thus, instead of using a loading mechanism, such as those previously discussed, the natural venturi action from the launch valve 140, in association with the applied air pressure to the storage tube 128, causes the pyrotechnic stars 12 to be continuously expelled from the launching tube 14 in a stream. A striker tube 16 may be used as the mechanism for igniting the pyrotechnic stars 12, but it will be understood that a flame 110 also could be used. In either case, this configuration of the launcher 10 is expected to produce a pyrotechnic effect that is visibly distinguished from the pyrotechnic effects created by existing fireworks mines or fountains.

FIG. 8 shows a further embodiment of the launcher 10 in which one pyrotechnic star 12 is launched at a time. Thus, the launcher 10 is designed for use as a single-shot device for hand-held applications, such as in a stage show indoors.

The launcher 10 of FIG. 8 comprises a launching tube 14 having a striker tube 16 at the upper end and a basic launch tube 18 with a launch chamber 146 at the lower end. A coupling 20 is provided to connect the striker tube 16 to the launch tube 18. A pair of spring clips 148 are provided in the launch chamber 146 to retain the pyrotechnic star 12 in position for launch.

Pressurized air is supplied to the launch chamber 146 by a cylinder 150 having a piston 152. The piston 152 may be retracted within the cylinder 150 away from the launch chamber 146 by a handle 154 or latching mechanism. As the piston 152 is withdrawn away from the launch chamber 146, a compression spring 156 on the handle 154 inside the cylinder 150 is compressed. When the handle 154 is released, the force of the spring 156 moves the piston 152 through the cylinder 150 and forces air out of the cylinder 150 through registered openings in the cylinder and the launch chamber 146, thereby expelling the pyrotechnic star 12 from the launching tube 14.

Figure 9:
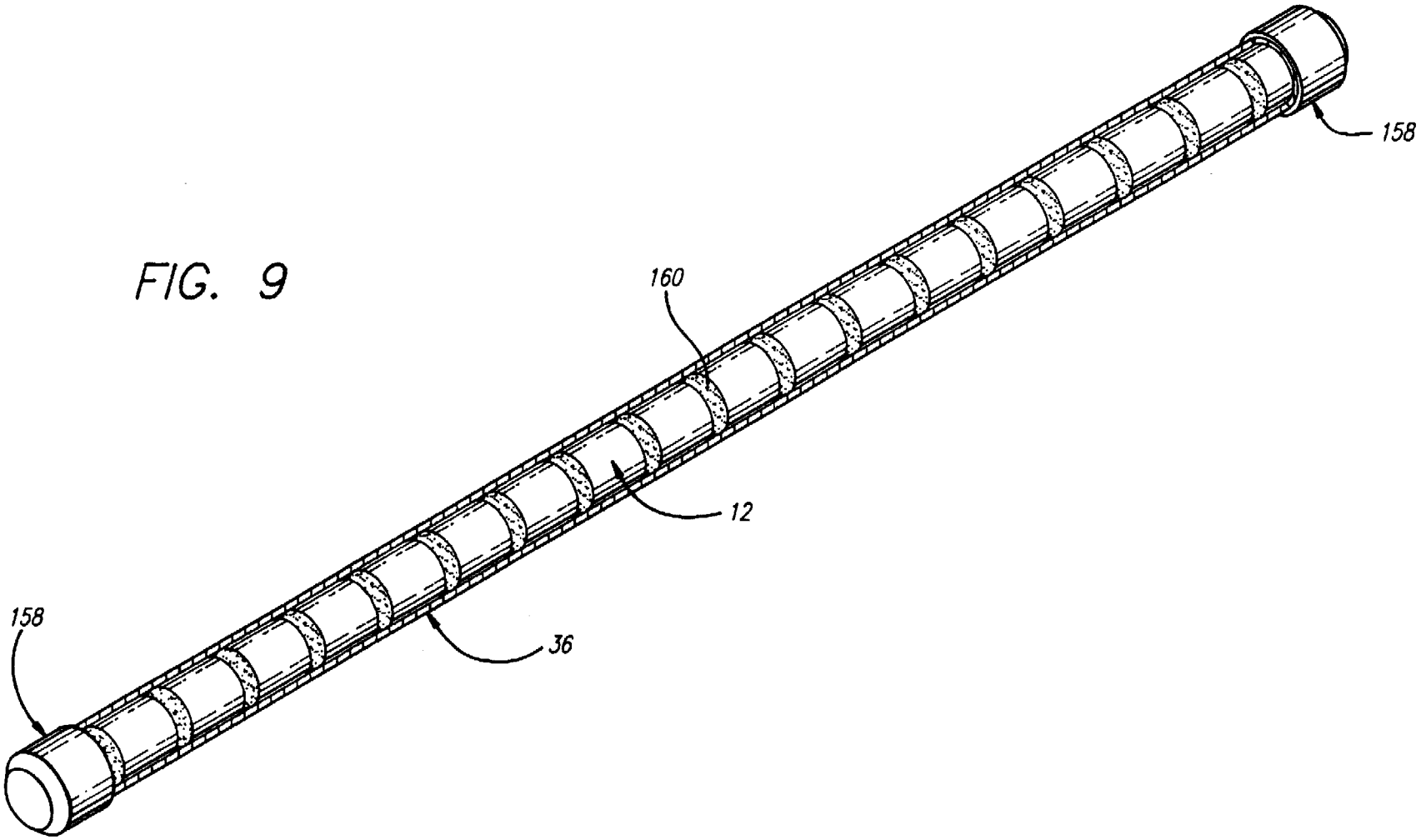
FIG. 9 is a cross-sectional perspective view of a storage tube for holding a plurality of pyrotechnic stars to be launched by the launcher.

FIG. 9 is a cross-sectional view of the storage tube 36 also being used as a shipping container loaded with pyrotechnic stars 12 from the pyrotechnic manufacturer. In this arrangement, cylindrically shaped stars 12 are stacked inside the storage tube 36 and the ends 37 and 44 of the tube are closed with removable end caps 158. To improve the overall safety of the system, inert material 160, such as sawdust, rice grains, or seeds, have been interposed between each star 12. This inert material 160 prevents adjacent stars 12 from contacting each other during shipment and improves the safety of the system over traditional arrangements. The inert material 160 will either drop down through the holes 3 in the base 46 of the launcher 10 or will be ejected with the star 12 during launch.

To load a storage tube 36 into the launcher 10, the empty storage tube is removed by sliding it axially upward through the brace 42. The end cap 158 on the lower end 37 of the new storage tube 36 is removed while the tube is moved axially into position. The end cap 158 on the upper end 44 of the loaded storage tube 36 can be left in place to prevent rain or other contaminants from entering the storage tube until show time. Hollow cylindrical end caps 158 are shown in FIG. 9, but it will be understood that adhesive tape or other suitable closure means could also be used. It is anticipated the storage tubes 36 will be made from cylindrically wound paper products and the exterior of these tubes could be color-coded to match the corresponding color of the pyrotechnic effects produced by the stars 12 inside that tube. It is also anticipated that the empty storage tubes 36 will be returned to the pyrotechnic manufacturer to be re-loaded for future use.

From the foregoing, it will be appreciated that the launcher 10 of the present invention is capable of launching pyrotechnic stars 12, such as roman candle fireworks stars, at a rapid rate and in a precise and repeatable manner. Moreover, the launcher 10 can launch a large number of such stars 12 from a single device at relatively high altitudes, while minimizing any detrimental environmental impact as a result of launching such a large number of stars. The rate at which the pyrotechnic stars 12 are launched and ignited also can be controlled with precision and repeatability.

While a particular form of the invention has been illustrated and described, it will be apparent that various modifications can be made without departing from the spirit and scope of the invention. Therefore, it is not intended that the invention be limited, except as by the appended claims.

We claim:

1. A launcher for launching a plurality of fireworks projectiles for creating an aerial fireworks display, comprising:

(a) a loading chamber for receiving a fireworks projectile to be launched;

(b) a launching tube having a lower end registerable with the loading chamber and an open upper end for expelling the fireworks projectile, said launching tube registered with said loading chamber while said plurality of fireworks are sequentially expelled from said launching tube;

(c) an igniter between the lower end and the open upper end of the launching tube that ignites the fireworks projectile as it is being expelled from the launching tube; and (d) a control apparatus for introducing a predetermined amount of a pressurized gas into the loading chamber to expel the fireworks projectile from the open upper end of the launching tube.

2. A launcher for launching a fireworks projectile for creating an aerial fireworks display, comprising:

a loading chamber for receiving a fireworks projectile to be launched;

a launching tube having a lower end registerable with the loading chamber and an open upper end for expelling the fireworks projectile;

an igniter between the lower end and the open upper end of the launching tube that ignites the fireworks projectile as it is being expelled from the launching tube; and a control apparatus for introducing a predetermined amount of a pressurized gas into the loading chamber to expel the fireworks projectile from the open upper end of the launching tube, wherein the igniter comprises an interior section of the launching tube having a reduced cross-section and having a striker composition thereon, and wherein the fireworks projectile is coated with a combustible composition that is ignited by frictional contact between the fireworks projectile and the striker composition as the fireworks projectile is expelled from the launching tube.

3. The launcher of claim 2, wherein the igniter is formed by a plurality of longitudinal slots in the launching tube and a band that radially contricts the launching tube in the area of the longitudinal slots to create an interior section having a locally reduced cross-sectional area.

4. The launcher of claim 3, wherein the band is comprised of an elastic material.

5. The launcher of claim 2, wherein the striker composition on the interior section of the launching tube comprises a composition containing red phosphorous.

6. The launcher of claim 5, wherein the combustible composition coated on the fireworks projectile comprises a composition containing potassium chlorate.

7. The launcher of claim 5, wherein the combustible composition containing potassium perchlorate.

8. The launcher of claim 1, wherein the launching tube is comprised of paper materials.

9. A launcher for launching a fireworks projectile for creating an aerial fireworks display, comprising:

(a) a loading chamber for receiving a fireworks projectile to be launched;

(b) a launching tube having a lower end registerable with the loading chamber and an open upper end for expelling the fireworks projectile;

(c) an igniter between the lower end and the open upper end of the launching tube that ignites the fireworks projectile as it is being expelled from the launching tube; and (d) a control apparatus for introducing a predetermined amount of a pressurized gas into the loading chamber to expel the, fireworks projectile from the open upper end of the launching tube wherein the igniter comprises an opening in the launching tube and a flame introduced through the opening into the launching tube to ignite the fireworks projectile as it is expelled from the launching tube.

10. The launcher of claim 1, wherein the igniter comprises an electrically heated element inside the launching tube that contacts and ignites the fireworks projectile as it is expelled from the launching tube.

11. A launcher for launching a fireworks projectile for creating an aerial fireworks display, comprising:

(a) a loading chamber for receiving a fireworks projectile to be launched;

(b) a launching tube having a lower end registerable with the loading chamber and an open upper end for expelling the fireworks projectile;

(c) an igniter between the lower end and the open upper end of the launching tube that ignites the fireworks projectile as it is being expelled from the launching tube; and (d) a control apparatus for introducing a predetermined amount of a pressurized gas into the loading chamber to expel the fireworks projectile from the open upper end of the launching tube, wherein the igniter comprises an electrically heated element inside the launching tube that contacts and ignites the fireworks projectile as it is expelled from the launching tube and the electrically heated element comprises a plurality of heated wires arranged longitudinally on the interior section of the launching tube.

12. The launcher of claim 1, further comprising a feeding mechanism for feeding fireworks projectiles into the loading chamber.

13. The launcher of claim 12, wherein the feeding mechanism comprises:

(a) at least one storage tube for holding a plurality of the fireworks projectiles;

(b) a manifold connected to the lower end of the launching tube and a lower end of the storage tube;

(c) a slide under the manifold having a load cylinder for receiving and transferring a fireworks projectile from the storage tube to the launching tube; and (d) a mechanism for reciprocating the slide between a first position, in which the load cylinder is registered below the storage tube for receiving a fireworks projectile therefrom, and a second position, in which the load cylinder is registered below the launching tube.

14. A launcher for launching a fireworks projectile for creating an aerial fireworks display, comprising:

a loading chamber for receiving a fireworks projectile to be launched;

a launching tube having a lower end registerable with the loading chamber and an open upper end for expelling the fireworks projectile;

an igniter between the lower end and the open upper end of the launching tube that ignites the fireworks projectile as it is being expelled from the launching tube;

a control apparatus for introducing a predetermined amount of a pressurized gas into the loading chamber to expel the fireworks projectile from the open upper end of the launching tube; and a feeding mechanism comprising:

at least one storage tube for holding a plurality of the fireworks projectiles;

a manifold connected to the lower end of the launching tube and a lower end of the storage tube;

a slide under the manifold having a load cylinder for receiving and transferring a fireworks projectile from the storage tube to the launching tube; and a mechanism for reciprocating the slide between a first position, in which the load cylinder is registered below the storage tube for receiving a fireworks projectile therefrom, and a second position, in which the load cylinder is registered below the launching tube; a plurality of storage tubes for holding a plurality of the fireworks projectiles, wherein a lower end of each storage tube is connected to the manifold, and wherein the slide has at least two load cylinders for receiving and transferring fireworks projectiles from the storage tubes to the launching tube.

15. The launcher of claim 14, wherein the storage tubes are arranged in a linear manner on opposite sides of the launching tube.

16. The launcher of claim 12, wherein the feeding mechanism comprises:

(a) a plurality of storage tubes arranged in a substantially cylindrical pattern for holding a plurality of the fireworks projectiles;

(b) a manifold connected to the lower end of the launching tube and to a lower end of each of the storage tubes;

(c) a substantially cylindrical plate under the manifold having a plurality of load cylinders for receiving and transferring fireworks projectiles from the storage tubes to the launching tube; and (d) a mechanism for rotating the plate in a stepped fashion, such that after a fireworks projectile has been expelled from the launching tube, the plate is rotated until another fireworks projectile from one of the storage tubes is brought into registration with the launching tube.

17. The launcher for launching a fireworks projectile for creating an aerial fireworks display, comprising:

a loading chamber for receiving a fireworks projectile to be launched;

a launching tube having a lower end registerable with the loading chamber and an open upper end for expelling the fireworks projectile;

an igniter between the lower end and the open upper end of the launching tube that ignites the fireworks projectile as it is being expelled from the launching tube; and a control apparatus for introducing a predetermined amount of a pressurized gas into the loading chamber to expel the fireworks projetile from the open upper end of the launching tube;

a feeding mechanism for feeding fireworks projectile into the loading chamber, wherein the feeding mechanism comprises a storage tube for holding a plurality of the fireworks projectiles having a top end connected to the launching tube and a lower end offset from the launching tube, such the after a fireworks projectile has been expelled from the launching tube by the pressurized gas, another fireworks projectile is fed into the launching tube by said pressurized gas.

18. The launcher of claim 1, wherein the control apparatus is a manually operated device comprising a cylinder having an opening registered with the loading chamber, a piston moveable within the cylinder, and an actuator connected to the piston that moves the piston toward the opening to force gas under pressure into the loading chamber and thereby expel the fireworks projectile from the launching tube.

19. The launcher of claim 1, further comprising a tilting mechanism for tilting the launcher and thereby selecting the launching angle of the fireworks projectile.

20. The launcher of claim 19, wherein the tilting mechanism comprises a motive element that rotates the launcher in a vertical plane to a selected rotary position.

21. A launcher for launching a fireworks projectile for creating an aerial fireworks display, comprising:

(a) a loading chamber for receiving a fireworks projectile to be launched;

(b) a launching tube having a lower end registerable with the loading chamber and an open upper end for expelling the fireworks projectile;

(c) an igniter between the lower end and the open upper end of the launching tube that ignites the fireworks projectile as it is being expelled from the launching tube;

(d) a feeding mechanism for feeding fireworks projectiles into the loading chamber from one or more storage tubes containing a plurality of the fireworks projectiles; and (e) a control apparatus for introducing a predetermined amount of a pressurized gas into the loading chamber to expel the fireworks projectile from the open upper end of the launching tube.

22. A launcher for launching a fireworks projectile for creating an aerial fireworks display, comprising:

a loading chamber for receiving a fireworks projectile to be launched;

a launching tube having a lower end registerable with the loading chamber and an open upper end for expelling the fireworks projectile;

an igniter between the lower end and the open upper end of the launching tube that ignites the fireworks projectile as it is being expelled from the launching tube;

a feeding mechanism for feeding fireworks projectiles into the loading chamber from one or more storage tubes containing a plurality of the fireworks projectiles; and a control apparatus for introducing a predetermined amount of a pressurized gas into the loading chamber to expel the fireworks projectile from the open upper end of the launching tube, wherein the feeding mechanism comprises:

(a) a plurality of storage tubes for holding a plurality of the fireworks projectiles;

(b) a manifold connected to the lower end of the launching tube and to a lower end of each of the storage tubes;

(c) a slide under the manifold having first and second load cylinders for receiving and transferring fireworks projectiles from the storage tubes to the launching tube; and (d) a mechanism for reciprocating the slide between a first position, in which the first load cylinder is registered below a first storage tube for receiving a fireworks projectile therefrom and the second load cylinder is registered below the launching tube, and a second position, in which the first load cylinder is registered below the launching tube and the second load cylinder is registered below a second storage tube.

23. The launcher of claim 22, wherein the slide is adapted to be reciprocated between the first position and the second position up to six times per second.

24. The launcher of claim 22, wherein the control apparatus controls the rate that the slide is reciprocated between the first position and the second position in synchronization with the introduction of pressurized gas into the loading chamber.

25. The launcher of claim 21, wherein the feeding mechanism comprises:

(a) a plurality of storage tubes arranged in a substantially cylindrical pattern for holding a plurality of the fireworks projectiles;

(b) a manifold connected to the lower end of the launching tube and to a lower end of each of the storage tubes;

(c) a substantially cylindrical plate under the manifold having a plurality of load cylinders for receiving and transferring fireworks projectiles from the storage tubes to the launching tube; and (d) a mechanism for rotating the plate in a stepped fashion, such that after a fireworks projectile has been expelled from the launching tube, the plate is rotated until another fireworks projectile from one of the storage tubes is brought into registration with the launching tube.

26. The launcher of claim 25, wherein the plate is adapted to be rotated to bring fireworks projectiles into registration with the launching tube up to six times per second.

* * * * *